US012449230B2

(12) United States Patent
Powell

(10) Patent No.: US 12,449,230 B2
(45) Date of Patent: Oct. 21, 2025

(54) ADJUSTABLE STOCK FOR A BB GUN

(71) Applicant: David N. Powell, Leon, KS (US)

(72) Inventor: David N. Powell, Leon, KS (US)

( * ) Notice: Subject to any disclaimer, the term of this patent is extended or adjusted under 35 U.S.C. 154(b) by 0 days.

(21) Appl. No.: 18/603,607

(22) Filed: Mar. 13, 2024

(65) Prior Publication Data

US 2024/0310144 A1 Sep. 19, 2024

Related U.S. Application Data

(60) Provisional application No. 63/489,889, filed on Mar. 13, 2023.

(51) Int. Cl.
*F41C 23/14* (2006.01)
*F41B 11/70* (2013.01)

(52) U.S. Cl.
CPC ..... *F41C 23/14* (2013.01); *F41B 11/70* (2013.01)

(58) Field of Classification Search
CPC ..... F41C 23/14; F41C 23/00; F41C 23/04; F41B 11/50; F41B 11/00
See application file for complete search history.

(56) References Cited

U.S. PATENT DOCUMENTS

| | | | | |
|---|---|---|---|---|
| 7,992,337 | B2 * | 8/2011 | Ochoa | F41C 23/14 42/74 |
| D679,772 | S * | 4/2013 | Mossberg, Jr. | D22/103 |
| D744,056 | S * | 11/2015 | Jammet | D22/108 |
| D744,057 | S * | 11/2015 | Jammet | F41C 23/12 D22/108 |
| 9,328,990 | B2 * | 5/2016 | Giannelli | F41C 7/06 |
| 11,841,208 | B1 * | 12/2023 | Roth | F41C 23/14 |
| 2009/0282718 | A1 * | 11/2009 | Bartley | F41C 23/12 42/75.03 |
| 2014/0259848 | A1 * | 9/2014 | Chvala | F41C 23/14 42/73 |
| 2016/0040956 | A1 * | 2/2016 | Giannelli | F41C 7/06 42/17 |
| 2021/0215451 | A1 * | 7/2021 | Ding | F41C 23/14 |
| 2023/0168064 | A1 * | 6/2023 | Angers, Jr. | F41C 23/14 42/73 |
| 2024/0085132 | A1 * | 3/2024 | Herring | F41A 11/02 |
| 2024/0255251 | A1 * | 8/2024 | Angers, Jr. | F41C 23/14 |
| 2025/0012542 | A1 * | 1/2025 | Freeman | F41C 23/16 |

* cited by examiner

*Primary Examiner* — Benjamin P Lee
(74) *Attorney, Agent, or Firm* — Eversheds Sutherland (US) LLP

(57) ABSTRACT

A BB gun may include a firing mechanism assembly and an adjustable stock. The adjustable stock may include an adapter coupled to the firing mechanism assembly and a butt stock movably coupled to the adapter for providing the BB gun with an adjustable length of pull. The butt stock may be configured to translate relative to the adapter and to be selectively secured relative to the adapter in a plurality of positions defining a plurality of different lengths of pull.

16 Claims, 5 Drawing Sheets

ADJUSTABLE STOCK FOR A BB GUN

CROSS-REFERENCE TO RELATED APPLICATIONS

The present application claims the benefit of and priority to U.S. Provisional Application No. 63/489,889, filed on Mar. 13, 2023, the disclosure of which is incorporated by reference herein in its entirety.

FIELD OF THE DISCLOSURE

The present disclosure relates generally to firearms and, more particularly, to an adjustable stock for a BB gun for allowing the BB gun to be used by persons having different body types or sizes.

BACKGROUND OF THE DISCLOSURE

Conventional BB guns, such as the BB gun shown in FIGS. 1-3, generally may be provided with stocks that have a fixed length. Accordingly, the length of a conventional BB gun may be fixed, lacking an option to change the length without modifying or replacing the stock. As a result, a given BB gun may be suitable for use by one person having a certain body type or size, but the BB gun may be unsuitable for use by another person having a different body type or size. For example, a particular BB gun may include a fixed stock that is well suited for use by a child but is too short in length for use by a larger child or an adult.

A need therefore remains for improved BB guns, stocks for BB guns, and related methods of manufacturing and using the same, which may overcome one or more of the foregoing drawbacks associated with existing BB guns.

SUMMARY OF THE DISCLOSURE

The present disclosure provides BB guns, adjustable stocks for a BB gun, and related methods of manufacturing and using such BB guns and adjustable stocks.

In one aspect, a BB gun is provided. According to one example, the BB gun A BB gun may include a firing mechanism assembly and an adjustable stock. The adjustable stock may include an adapter coupled to the firing mechanism assembly and a butt stock movably coupled to the adapter for providing the BB gun with an adjustable length of pull. The butt stock may be configured to translate relative to the adapter and to be selectively secured relative to the adapter in a plurality of positions defining a plurality of different lengths of pull.

In some examples, the adapter may include a distal portion coupled to the firing mechanism assembly by one or more fasteners, and a proximal portion coupled to the butt stock. In some examples, at least part of the distal portion the adapter may be received within a frame of the firing mechanism assembly and secured therein by the one or more fasteners. In some examples, the distal portion of the adapter may include a groove defined along a bottom side of the distal portion of the adapter and removably receiving at least part of a lever of the firing mechanism assembly therein. In some examples, the butt stock may include a body defining a receptacle receiving at least part of the proximal portion of the adapter therein, a lever movably coupled to the body and configured to pivot relative to the body between a first position and a second position, and a positioning pin coupled to the lever and configured to engage the proximal portion of the adapter when the lever is in the first position to selectively secure the butt stock relative to the adapter in each of the plurality of positions and to disengage the proximal portion of the adapter when the lever is in the second position to allow translation of the butt stock relative to the adapter. In some examples, the proximal portion of the adapter may include a plurality of recesses each corresponding to one of the plurality of positions, and the positioning pin may be configured to engage a respective recess of the plurality of recesses to selectively secure the butt stock relative to the adapter in a corresponding position of the plurality of positions. In some examples, the proximal portion of the adapter may include a shaft having a cylindrical shape, and a ridge extending along the shaft, and the receptacle of the butt stock may include a first portion receiving at least part of the shaft of the proximal portion of the adapter therein, and a second portion receiving at least part of the ridge of the proximal portion of the adapter therein to inhibit rotational movement of the butt stock relative to the adapter. In some examples, the ridge may be disposed along a bottom side of the proximal portion of the adapter. In some examples, the plurality of recesses may be defined in the ridge of the proximal portion of the adapter. In some examples, the butt stock may be removably coupled to the adapter.

In another aspect, an adjustable stock for a BB gun is provided. According to one example, the adjustable stock may include an adapter configured to couple to a firing mechanism assembly of the BB gun, and a butt stock movably coupled to the adapter for providing the BB gun with an adjustable length of pull, the butt stock configured to translate relative to the adapter and to be selectively secured relative to the adapter in a plurality of positions defining a plurality of different lengths of pull.

In some examples, the adapter may include a distal portion configured to be coupled to the firing mechanism assembly by one or more fasteners, and a proximal portion coupled to the butt stock. In some examples, at least part of the distal portion the adapter may be configured to be received within a frame of the firing mechanism assembly and secured therein by the one or more fasteners. In some examples, the distal portion of the adapter may include a groove defined along a bottom side of the distal portion of the adapter and configured to removably receive at least part of a lever of the firing mechanism assembly therein. In some examples, the butt stock may include a body defining a receptacle receiving at least part of the proximal portion of the adapter therein, a lever movably coupled to the body and configured to pivot relative to the body between a first position and a second position, and a positioning pin coupled to the lever and configured to engage the proximal portion of the adapter when the lever is in the first position to selectively secure the butt stock relative to the adapter in each of the plurality of positions and to disengage the proximal portion of the adapter when the lever is in the second position to allow translation of the butt stock relative to the adapter. In some examples, the proximal portion of the adapter may include a plurality of recesses each corresponding to one of the plurality of positions, and the positioning pin may be configured to engage a respective recess of the plurality of recesses to selectively secure the butt stock relative to the adapter in a corresponding position of the plurality of positions. In some examples, the proximal portion of the adapter may include a shaft having a cylindrical shape, and a ridge extending along the shaft, and the receptacle of the butt stock may include a first portion receiving at least part of the shaft of the proximal portion of the adapter therein, and a second portion receiving at least part of the ridge of the proximal portion of the adapter therein to inhibit rotational movement of the butt stock relative to the adapter. In some examples, the ridge may be disposed along a bottom side of the proximal portion of the adapter. In some examples, the plurality of recesses may be defined in the ridge of the proximal portion of the adapter. In some examples, the butt stock may be removably coupled to the adapter.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain examples of the present disclosure may include elements, components, and/or configurations other than those illustrated in the drawings, and some of the elements, components, and/or configurations illustrated in the drawings may not be present in certain examples.

DETAILED DESCRIPTION OF THE DISCLOSURE

Figure 1:
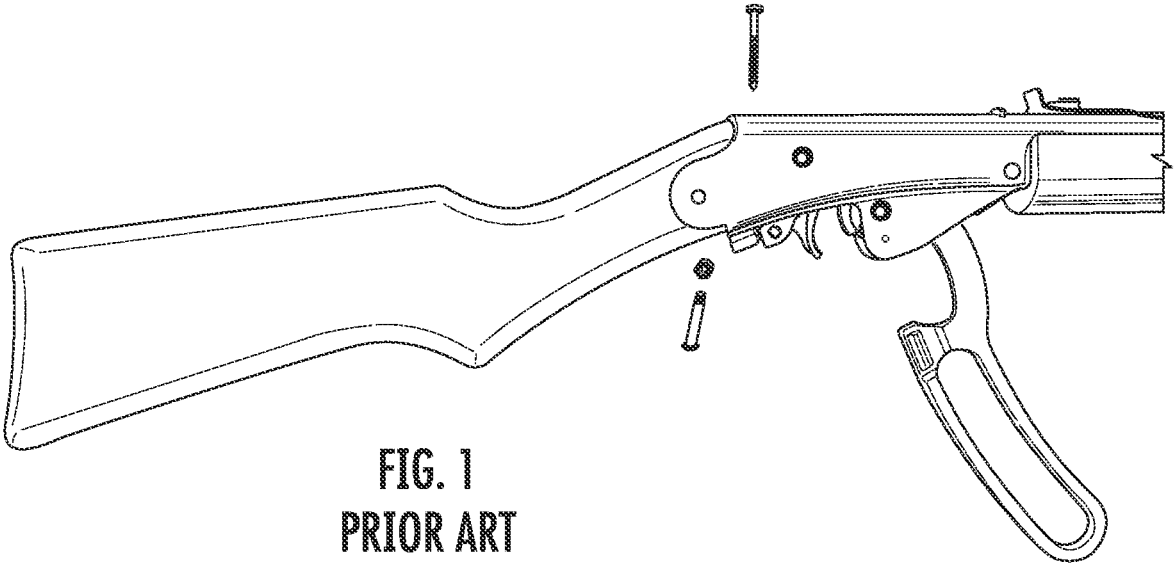
FIG. 1 PRIOR ART
FIG. 1 is a side view of a portion of a prior art BB gun, showing a fixed stock, a firing mechanism assembly, and fasteners of the BB gun.

In the following description, specific details are set forth describing some examples consistent with the present disclosure. Numerous specific details are set forth in order to provide a thorough understanding of the examples. It will be apparent, however, to one skilled in the art that some examples may be practiced without some or all of these specific details. The specific examples disclosed herein are meant to be illustrative but not limiting. One skilled in the art may realize other examples that, although not specifically described here, are within the scope and the spirit of this disclosure. In addition, to avoid unnecessary repetition, one or more features shown and described in association with one example may be incorporated into other examples unless specifically described otherwise or if the one or more features would make an example non-functional. In some instances, well known methods, procedures, and components have not been described in detail so as not to unnecessarily obscure aspects of the examples. As employed herein, the term "coupled" shall mean that components are connected together either directly or indirectly via one or more intermediate parts or components.

The present disclosure provides BB guns having an adjustable stock, adjustable stocks for a BB gun, and related methods of manufacturing and using such BB guns and adjustable stocks. In some examples, an adjustable stock may include an adapter and a butt stock. The adapter may be configured to couple to a firing mechanism assembly of the BB gun. The butt stock may be movably coupled to the adapter for providing the BB gun with an adjustable length of pull, and the butt stock may be configured to translate relative to the adapter and to be selectively secured relative to the adapter in a plurality of positions defining a plurality of different lengths of pull. In this manner, the adjustable stock may overcome one or more of the foregoing drawbacks associated with existing BB guns having a fixed stock. In particular, the adjustable stock may provide an option to adjust the length of pull of the BB gun, thereby allowing users of different body types of sizes to use the BB gun in a suitable manner. For example, the adjustable stock may be adjusted to provide a first length of pull that is well suited for a child and subsequently may be adjusted to provide a greater second length of pull that is suitable for a larger child or an adult.

As described herein, in some examples, the adapter may include a distal portion configured to be coupled to the firing mechanism assembly by one or more fasteners, and a proximal portion coupled to the butt stock. In some examples, at least part of the distal portion the adapter may be configured to be received within a frame of the firing mechanism assembly and secured therein by the one or more fasteners. In some examples, the distal portion of the adapter may include a groove defined along a bottom side of the distal portion of the adapter and configured to removably receive at least part of a lever of the firing mechanism assembly therein. In some examples, the butt stock may include a body defining a receptacle receiving at least part of the proximal portion of the adapter therein, a lever movably coupled to the body and configured to pivot relative to the body between a first position and a second position, and a positioning pin coupled to the lever and configured to engage the proximal portion of the adapter when the lever is in the first position to selectively secure the butt stock relative to the adapter in each of the plurality of positions and to disengage the proximal portion of the adapter when the lever is in the second position to allow translation of the butt stock relative to the adapter. In some examples, the proximal portion of the adapter may include a plurality of recesses each corresponding to one of the plurality of positions, and the positioning pin may be configured to engage a respective recess of the plurality of recesses to selectively secure the butt stock relative to the adapter in a corresponding position of the plurality of positions. In some examples, the proximal portion of the adapter may include a shaft having a cylindrical shape, and a ridge extending along the shaft, and the receptacle of the butt stock may include a first portion receiving at least part of the shaft of the proximal portion of the adapter therein, and a second portion receiving at least part of the ridge of the proximal portion of the adapter therein to inhibit rotational movement of the butt stock relative to the adapter. In some examples, the ridge may be disposed along a bottom side of the proximal portion of the adapter. In some examples, the plurality of recesses may be defined in the ridge of the proximal portion of the adapter. In some examples, the butt stock may be removably coupled to the adapter.

Still other benefits and advantages of the BB guns, adjustable stocks for a BB gun, and related methods provided herein over conventional devices and techniques will be appreciated by those of ordinary skill in the art from the present disclosure.

Example BB Guns and Adjustable Stocks

Figure 2:
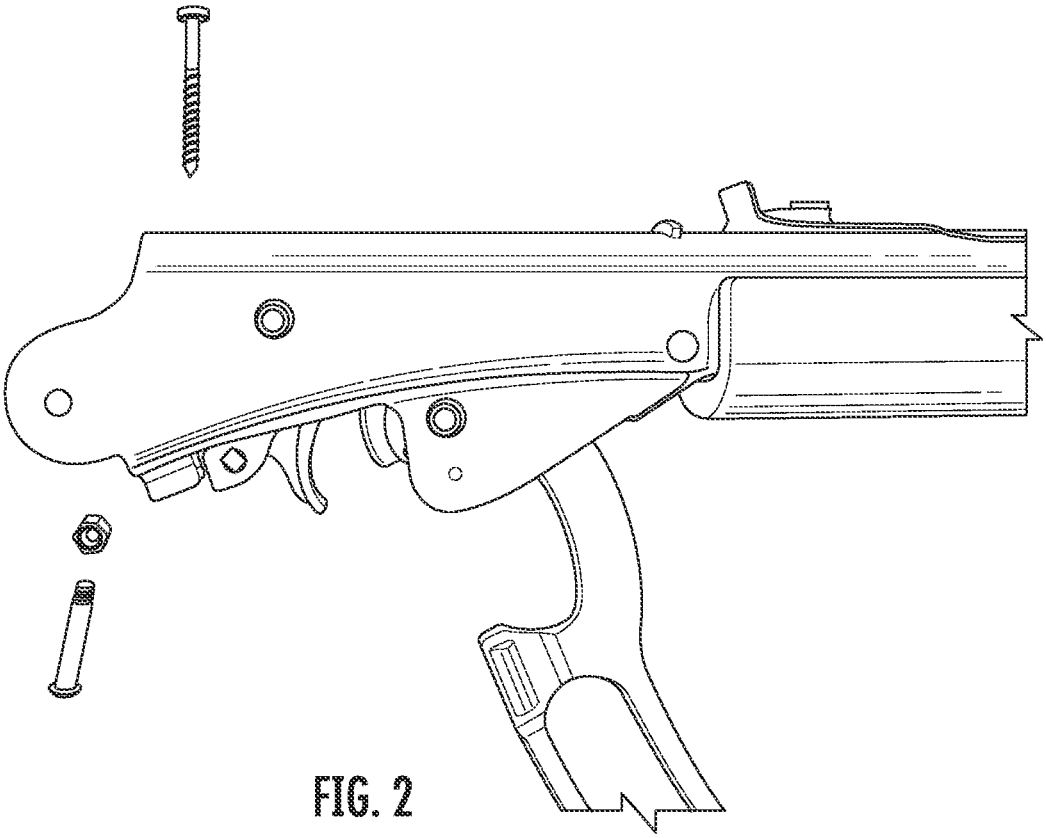
FIG. 2 PRIOR ART
FIG. 2 is a side view of a portion of the prior art BB gun of FIG. 1, showing the firing mechanism assembly and the fasteners, with the fixed stock removed from the firing mechanism assembly.
Figure 3:
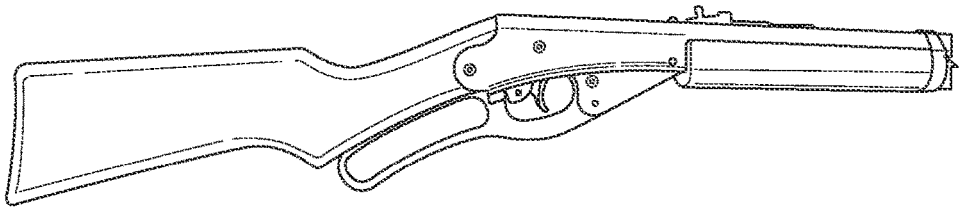
FIG. 3 PRIOR ART
FIG. 3 is a side view of a portion of the prior art BB gun of FIG. 1, showing the fixed stock coupled to the firing mechanism assembly via the fasteners.
Figure 4:
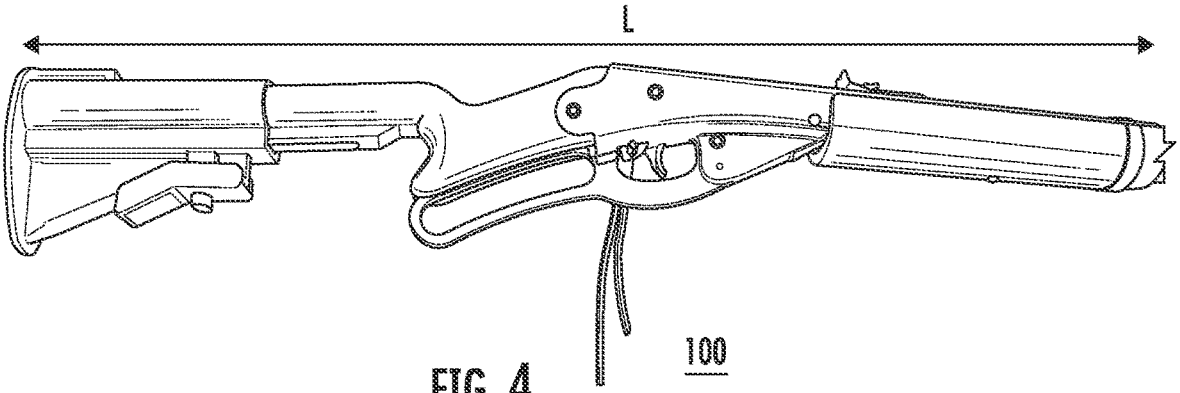
FIG. 4 is a side view of a portion of a BB gun according to one or more examples of the disclosure, showing an adjustable stock, a firing mechanism assembly, and fasteners of the BB gun, with the adjustable stock including a butt stock and an adapter.

Referring now to the drawings, FIGS. 1-3 illustrate a prior art BB gun, while FIGS. 4-13 depict a BB gun 100 and components of the BB gun 100 according to one or more examples of the present disclosure. As shown, the BB gun 100 may be an elongate assembly having a proximal end (i.e., a butt end) and a distal end (i.e., a muzzle end) disposed opposite one another along a longitudinal axis of the BB gun 100. As shown, the BB gun 100 may include a firing mechanism assembly 101 and an adjustable stock (which also may be referred to as an "adapter assembly") coupled to the firing mechanism assembly 101 via one or more fasteners, such as screws, bolts and nuts, etc. The firing mechanism assembly 101 may be configured for firing BBs from the BB gun upon actuation of the firing mechanism assembly 101 by a user, for example, by actuating the lever and pulling the trigger of the firing mechanism assembly 101.

As shown, the adjustable stock may include an adapter 102 and a butt stock 104 movably coupled to the adapter 102. As described, the adapter 102 and the butt stock 104 advantageously may provide the BB gun 100 with an adjustable length of pull. That is, unlike prior art BB guns (e.g., the BB gun depicted in FIGS. 1-3), the BB gun 100 has a length L (see, e.g., FIG. 4) that is adjustable in a simple and reliable manner, thereby allowing the BB gun 100 to accommodate users having different body types and sizes. For example, a user who may be four feet five inches tall can use the BB gun 100 when the BB gun 100 is configured to have a first length, and, after the adjustable stock has been adjusted (i.e., the adapter 102 and the butt stock 104 are adjusted to provide a greater length of pull), another user who may be six feet tall can use the BB gun 100 reconfigured to have a different second length. As disclosed, the butt stock 104 may be movably coupled to the adapter 102 for providing the BB gun 100 with an adjustable length of pull. According to the illustrated examples, the butt stock 104 may be configured to translate relative to the adapter 102 and to be selectively secured relative to the adapter 102 in a plurality of positions defining a plurality of different lengths of pull.

Figure 5:
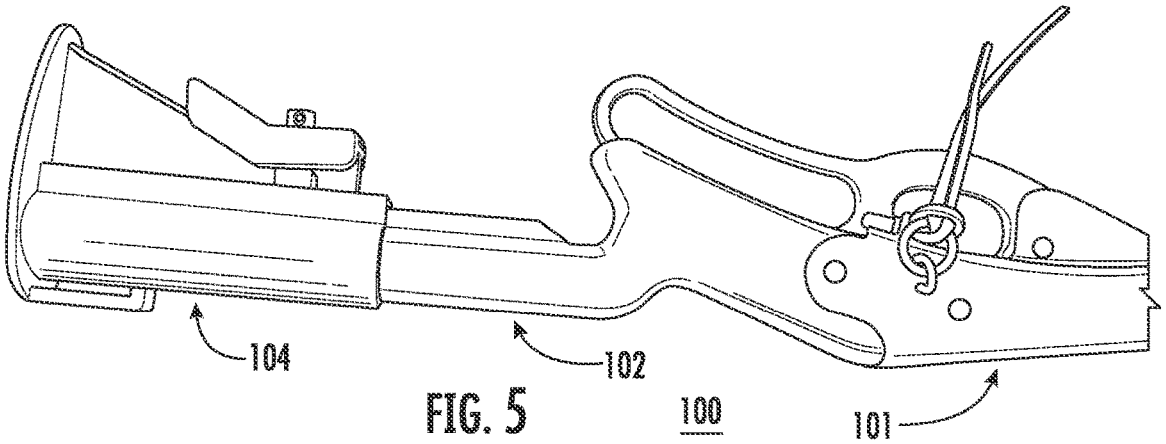
FIG. 5 is an opposite side view of a portion of the BB gun of FIG. 4, showing the butt stock and the adapter of the adjustable stock and the firing mechanism.
Figure 6:
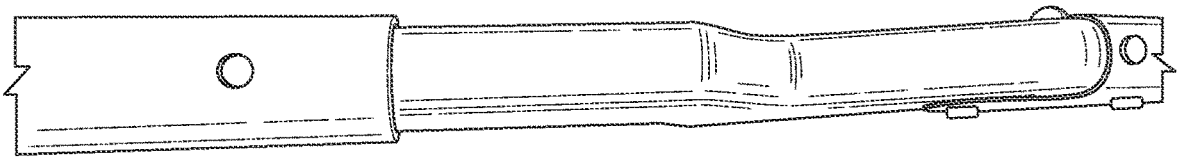
FIG. 6 is a top view of a portion of the BB gun of FIG. 4, showing the butt stock and the adapter of the adjustable stock and a portion of the firing mechanism.
Figure 7:
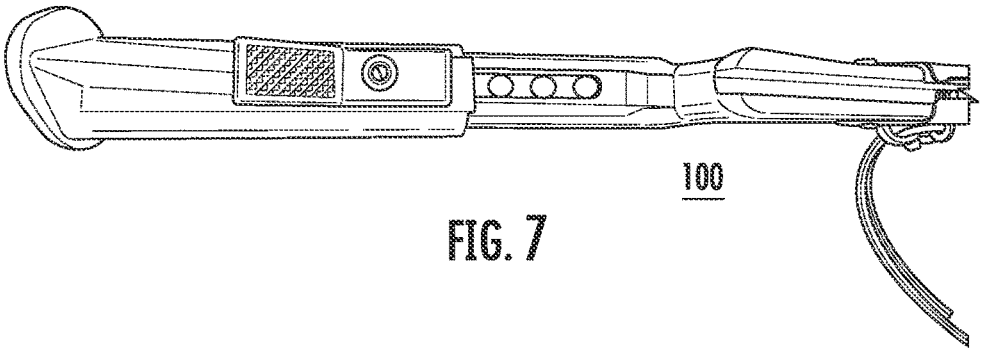
FIG. 7 is a bottom view of a portion of the BB gun of FIG. 4, showing the butt stock and the adapter of the adjustable stock and a portion of the firing mechanism.
Figure 8:
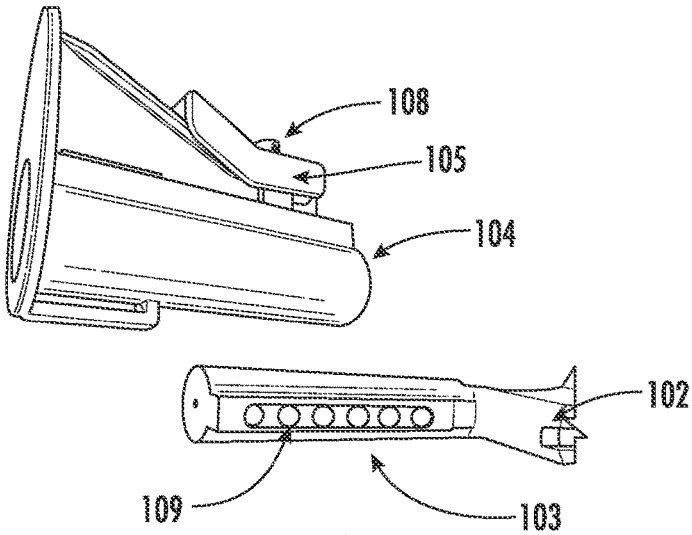
FIG. 8 is a perspective view of the butt stock and a portion of the adapter of the adjustable stock of the BB gun of FIG. 4.
Figure 9:
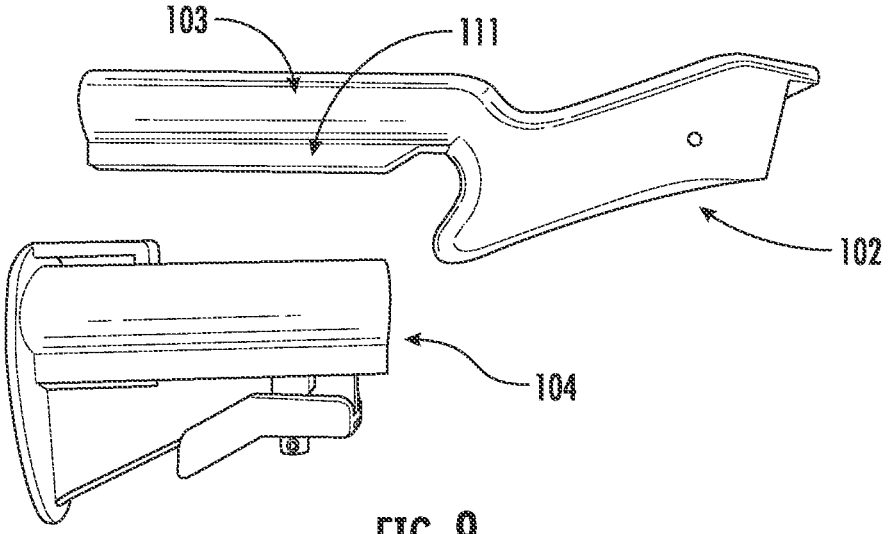
FIG. 9 is a side view of the butt stock and the adapter of the adjustable stock of the BB gun of FIG. 4.
Figure 10:
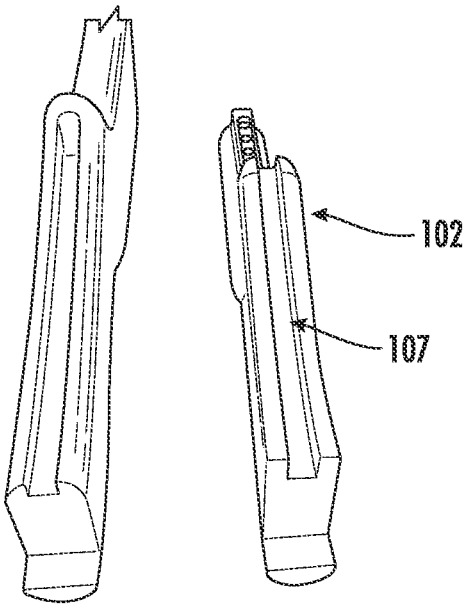
FIG. 10 is a perspective view of the adapter of the adjustable stock of the BB gun of FIG. 4 and the fixed stock of the prior art BB gun of FIG. 1.
Figure 11:
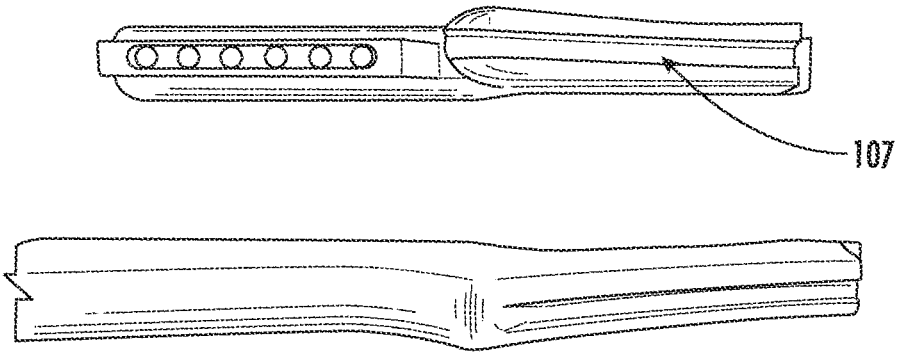
FIG. 11 is a perspective view of the adapter of the adjustable stock of the BB gun of FIG. 4 and the fixed stock of the prior art BB gun of FIG. 1.
Figure 12:
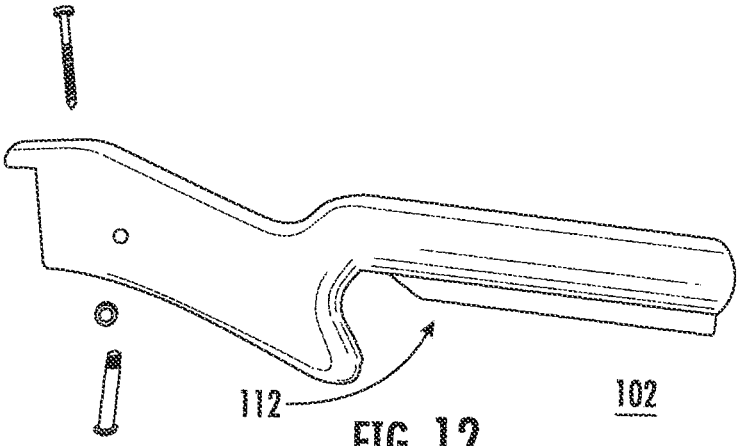
FIG. 12 is a side view of the adapter of the adjustable stock and the fasteners of the BB gun of FIG. 4.
Figure 13:
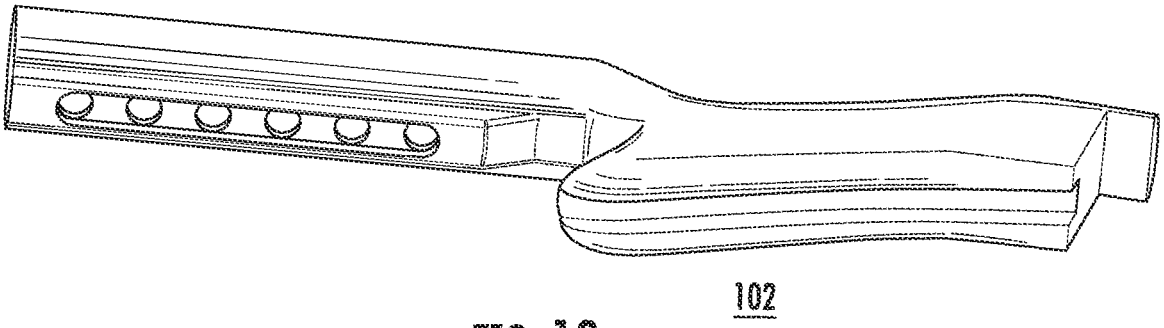
FIG. 13 is a perspective view of the adapter of the adjustable stock of the BB gun of FIG. 4.

FIGS. 5-7 show the adapter 102 and the butt stock 104 of the adjustable stock in an assembled state and coupled to the firing mechanism assembly 101 of the BB gun 100, while FIGS. 8 and 9 show a disassembled state of the adapter 102 and the butt stock 104. FIGS. 10 and 11 show the adapter 102 in comparison to the fixed stock of the prior art BB gun of FIGS. 1-3. FIGS. 12 and 13 show different views of the adapter 102 and fasteners used for coupling the adapter 102 to the firing mechanism assembly 101 of the BB gun 100.

As shown, the adapter 102 may include a distal portion and a proximal portion. The distal portion of the adapter 102 may be coupled to the firing mechanism assembly 101 by one or more fasteners, and the proximal portion of the adapter 102 may be movably coupled to the butt stock 104, as described below. As shown, when the BB gun is assembled, at least part of the distal portion of the adapter 102 may be received within the frame of the firing mechanism assembly 101 and secured therein by the one or more fasteners. In some examples, as shown, the distal portion of the adapter 102 may include a groove 107 defined along a bottom side of the distal portion of the adapter 102 and removably receiving at least part of the lever of the firing mechanism assembly 101 therein when the lever is not engaged in a cocking action. In some examples, as shown, the proximal portion of the adapter 102 may include a shaft 103 having a cylindrical shape and a ridge 111 that extends along the shaft 103. As shown, the ridge 111 may be disposed along the bottom side of the proximal portion of the adapter 102. The proximal portion of the adapter 102 may include a plurality of recesses 109 (although six (6) of the recesses 109 are shown in the illustrated example, more or fewer of the recesses 109 may be provided in other examples) each corresponding to one of the plurality of positions of the adjustable stock. As shown, the recesses 109 may be defined in the ridge 111 of the proximal portion of the adapter 102 and may be selectively engaged by the butt stock 104. In this manner, the ridge 111 may align the recesses 109 for engagement with mating structure of the butt stock 104, as described below. As shown, the ridge 111 may include an end portion 112 that is angled or beveled.

As shown, the butt stock 104 may include a body, a lever 105, and a positioning pin 108. The body may define a receptacle that receives at least part of the proximal portion of the adapter 102 therein. The lever 105 may be movably coupled to the body and configured to pivot relative to the body between a first position and a second position. The positioning pin 108 may be coupled to the lever 105 and configured to engage the proximal portion of the adapter 102 when the lever 105 is in the first position to selectively secure the butt stock 104 relative to the adapter 102 in each of the plurality of positions and to disengage the proximal portion of the adapter 102 when the lever 105 is in the second position to allow translation of the butt stock 104 relative to the adapter 102. As shown, the receptacle of the butt stock 104 may include a first portion for receiving at least part of the shaft 103 of the proximal portion of the adapter 102 therein, and a second portion for receiving at least part of the ridge 111 of the proximal portion of the adapter 102. The shapes of the first portion and the second portion of the receptacle of the butt stock 104 may complement the mating shapes of the shaft 103 and the ridge 111 of the proximal portion of the adapter 102, thereby inhibiting rotational movement of the butt stock 104 relative to the adapter 102. The positioning pin 108 may be configured to engage a respective recess 109 of the plurality of recesses 109 to selectively secure the butt stock 104 relative to the adapter 102 in a corresponding position of the plurality of positions, thereby providing an adjustable length of pull.

More specifically, when a user presses the lever 105, the associated positioning pin 108 may be actuated from the first position to the second position, thereby allowing the butt stock 104 to slidably engage the shaft portion 103 of the adapter 102, thereby allowing the butt stock 104 to be translated relative to the adapter 102 to a desired position. In turn, when the lever 105 is released from the second position and returns to the first position, such as by a biasing spring, the positioning pin 108 may engage a corresponding recesses 109 (6 of which are provided in the illustrated embodiment, though more or fewer may be provided). This functionality advantageously allows for a variable length BB gun 100 (see length L in FIG. 4). That is, if a shorter user wishes to use the BB gun 100, that user can press the lever 105, cause the adapter 102 to extend deeper into the butt stock 104, and then release the lever 105 to secure the butt stock 104 to the adapter 102 via the positioning pin 108 and the corresponding recess 109. Similarly, if a taller user (e.g., one who might need to use a longer BB gun) wishes to use the BB gun 100, that user can press the lever 105, cause the adapter 102 to extend further out of the butt stock 104, and then release the lever 105 to secure the butt stock 104 to the adapter 102 via the positioning pin 108 and corresponding recess 109. The shaft 103 extends from a distal portion of the adapter 102 that couples to the firing mechanism assembly 101 at a position on an upper edge of the distal portion that does not interfere with the user's grip on the adapter 102 when using the BB gun 100. Further, the position at which the shaft 103 extends from the distal portion provides for proper alignment for placement of the butt stock against the user's shoulder while aiming and firing the BB gun. For example, the longitudinal axis of the shaft 103 may be between the longitudinal axis of the barrel of the BB gun 100 and the trigger of the firing mechanism assembly 101.

Although specific examples of the disclosure have been described, numerous other modifications and alternative examples are within the scope of the disclosure. For example, any of the functionality described with respect to a particular device or component may be performed by another device or component. Further, while specific device characteristics have been described, examples of the disclosure may relate to numerous other device characteristics. Further, although examples have been described in language specific to structural features and/or methodological acts, it is to be understood that the disclosure is not necessarily limited to the specific features or acts described. Rather, the specific features and acts are disclosed as illustrative forms of implementing the examples. Conditional language, such as, among others, "can," "could," "might," or "may," unless specifically stated otherwise, or otherwise understood within the context as used, is generally intended to convey that certain examples could include, while other examples may not include, certain features, elements, and/or steps. Thus, such conditional language is not generally intended to imply that features, elements, and/or steps are in any way required for one or more examples.

I claim:

1. A BB gun comprising:

a firing mechanism assembly; and an adjustable stock comprising:

an adapter coupled to the firing mechanism assembly, the adapter comprising a distal portion coupled to the firing mechanism assembly by one or more fasteners and a proximal portion coupled to the butt stock, and wherein the distal portion of the adapter comprises a groove defined along a bottom side of the distal portion of the adapter configured to removably receiving at least part of a lever of the firing mechanism assembly therein; and a butt stock movably coupled to the adapter for providing the BB gun with an adjustable length of pull, the butt stock configured to translate relative to the adapter and to be selectively secured relative to the adapter in a plurality of positions defining a plurality of different lengths of pull.

2. The BB gun of claim 1, wherein at least part of the distal portion the adapter is received within a frame of the firing mechanism assembly and secured therein by the one or more fasteners.

3. The BB gun of claim 1, wherein the butt stock comprises:

a body defining a receptacle receiving at least part of the proximal portion of the adapter therein;

a lever movably coupled to the body and configured to pivot relative to the body between a first position and a second position; and a positioning pin coupled to the lever and configured to engage the proximal portion of the adapter when the lever is in the first position to selectively secure the butt stock relative to the adapter in each of the plurality of positions and to disengage the proximal portion of the adapter when the lever is in the second position to allow translation of the butt stock relative to the adapter.

4. The BB gun of claim 3, wherein:

the proximal portion of the adapter comprises a plurality of recesses each corresponding to one of the plurality of positions; and the positioning pin is configured to engage a respective recess of the plurality of recesses to selectively secure the butt stock relative to the adapter in a corresponding position of the plurality of positions.

5. The BB gun of claim 3, wherein:

the proximal portion of the adapter comprises:

a shaft having a cylindrical shape; and a ridge extending along the shaft; and the receptacle of the butt stock comprises:

a first portion receiving at least part of the shaft of the proximal portion of the adapter therein; and a second portion receiving at least part of the ridge of the proximal portion of the adapter therein to inhibit rotational movement of the butt stock relative to the adapter.

6. The BB gun of claim 5, wherein the ridge is disposed along a bottom side of the proximal portion of the adapter.

7. The BB gun of claim 5, wherein the plurality of recesses are defined in the ridge of the proximal portion of the adapter.

8. The BB gun of claim 1, wherein the butt stock is removably coupled to the adapter.

9. An adjustable stock for a BB gun, the adjustable stock comprising:

an adapter configured to couple to a firing mechanism assembly of the BB gun, the adapter comprising a distal portion configured to be coupled to the firing mechanism assembly by one or more fasteners and a proximal portion coupled to the butt stock, wherein the distal portion of the adapter comprises a groove defined along a bottom side of the distal portion of the adapter and configured to removably receive at least part of a lever of the firing mechanism assembly therein; and a butt stock movably coupled to the adapter for providing the BB gun with an adjustable length of pull, the butt stock configured to translate relative to the adapter and to be selectively secured relative to the adapter in a plurality of positions defining a plurality of different lengths of pull.

10. The adjustable stock of claim 9, wherein at least part of the distal portion of the adapter is configured to be received within a frame of the firing mechanism assembly and secured therein by the one or more fasteners.

11. The adjustable stock of claim 9, wherein the butt stock comprises:

a body defining a receptacle receiving at least part of the proximal portion of the adapter therein;

a lever movably coupled to the body and configured to pivot relative to the body between a first position and a second position; and a positioning pin coupled to the lever and configured to engage the proximal portion of the adapter when the lever is in the first position to selectively secure the butt stock relative to the adapter in each of the plurality of positions and to disengage the proximal portion of the adapter when the lever is in the second position to allow translation of the butt stock relative to the adapter.

12. The adjustable stock of claim 11, wherein:

the proximal portion of the adapter comprises a plurality of recesses each corresponding to one of the plurality of positions; and the positioning pin is configured to engage a respective recess of the plurality of recesses to selectively secure the butt stock relative to the adapter in a corresponding position of the plurality of positions.

13. The adjustable stock of claim 11, wherein:

the proximal portion of the adapter comprises:

a shaft having a cylindrical shape; and a ridge extending along the shaft; and the receptacle of the butt stock comprises:

a first portion receiving at least part of the shaft of the proximal portion of the adapter therein; and a second portion receiving at least part of the ridge of the proximal portion of the adapter therein to inhibit rotational movement of the butt stock relative to the adapter.

14. The adjustable stock of claim 13, wherein the ridge is disposed along a bottom side of the proximal portion of the adapter.

15. The adjustable stock of claim 13, wherein the plurality of recesses are defined in the ridge of the proximal portion of the adapter.

16. The adjustable stock of claim 9, wherein the butt stock is removably coupled to the adapter.

* * * * *